United States Patent [19]

Maertens

[11] Patent Number: 4,964,786

[45] Date of Patent: Oct. 23, 1990

[54] COMPRESSOR MOUNTING APPARATUS

[75] Inventor: Michael J. Maertens, Adrian, Mich.

[73] Assignee: Tecumseh Products Company, Tecumseh, Mich.

[21] Appl. No.: 365,696

[22] Filed: Jun. 14, 1989

[51] Int. Cl.[5] ..... F04B 39/00

[52] U.S. Cl. ..... 417/363; 417/902

[58] Field of Search ..... 417/360, 363, 902; 248/632, 634, 638

[56] References Cited

U.S. PATENT DOCUMENTS

| | | | |
|---|---|---|---|
| 1,574,985 | 3/1926 | McWain . | |
| 1,864,150 | 6/1932 | Shields . | |
| 1,911,804 | 5/1933 | Carpenter . | |
| 1,947,501 | 2/1934 | Sharp . | |
| 2,384,410 | 9/1945 | Yates . | |
| 2,933,241 | 4/1960 | Braskamp | 417/363 X |
| 2,935,279 | 5/1960 | LaPorte et al. . | |
| 2,964,236 | 12/1960 | Kasper | 417/363 |
| 3,286,960 | 11/1966 | Douglas et al. . | |
| 3,493,201 | 2/1970 | Marran . | |
| 3,510,137 | 5/1970 | Freier . | |
| 3,790,115 | 2/1974 | Fox et al. . | |
| 4,132,194 | 1/1979 | Saito | 248/638 X |
| 4,180,231 | 12/1979 | Burnham . | |
| 4,264,282 | 4/1981 | Crago . | |
| 4,399,975 | 8/1983 | Trimarco et al. . | |
| 4,461,446 | 7/1984 | Hannibal et al. . | |
| 4,534,225 | 8/1985 | Peacock et al. | 248/632 X |
| 4,569,637 | 2/1986 | Tuckey | 417/363 X |
| 4,579,184 | 4/1986 | Hiramoto | 248/635 X |
| 4,643,386 | 2/1987 | Chastine . | |
| 4,730,994 | 3/1988 | Maertens | 417/902 X |
| 4,768,925 | 9/1988 | Geupel | 417/363 X |

FOREIGN PATENT DOCUMENTS

| | | | |
|---|---|---|---|
| 60-132080 | 7/1985 | Japan | 417/363 |
| 62-159777 | 7/1987 | Japan | 417/363 |
| 62-214282 | 9/1987 | Japan | 417/363 |
| 62-214283 | 9/1987 | Japan | 417/363 |
| 62-214284 | 9/1987 | Japan | 417/363 |

*Primary Examiner*—Leonard E. Smith
*Assistant Examiner*—Eugene L. Szczecina, Jr.
*Attorney, Agent, or Firm*—Jeffers, Hoffman & Niewyk

[57] ABSTRACT

The present invention is a vertically upright hermetic compressor for mounting to a horizontal support surface. The compressor comprises a housing with a bottom end having an annular groove, a motor compressor unit operably disposed within the housing, and a mounting boot. The mounting boot is affixed to the housing's bottom end, having a resilient body member engaged with the groove to secure vertically the housing. An adhesive is used to bond the boot to the housing bottom, and adhesive can be used to secure the boot to a horizontal support surface of an appliance.

9 Claims, 1 Drawing Sheet

COMPRESSOR MOUNTING APPARATUS

BACKGROUND OF THE INVENTION

The field of the invention is that of hermetic compressors installed in appliances such as refrigerators, freezers, air conditioners, dehumidifiers, and the like. More particularly, the field is that of apparatus for mounting a compressor to an appliance frame, enclosure, or cabinet.

Hermetic compressors comprise a motor-compressor unit disposed within a hermetically sealed outer housing. An electrical connection is made via a terminal which extends through a sidewall of the housing, while fluid conduits extend through the sidewall to provide an external connection for the refrigerant fluids. The hermetic compressor is easily incorporated into an appliance by mounting the compressor to the appliance cabinet and making the appropriate electrical and fluid connections. However, compressors generate undesired noise and vibration which can only be reduced by mounting the compressor in a manner which suppresses the undesired noise and vibrations.

Various structures are used to mount a hermetic rotary compressor in an appliance cabinet, typically upon a horizontal surface in an upright position. One structure has a base plate welded to the bottom of the compressor housing, with the base plate having a plurality of holes that have grommets forcibly fit into them. The grommets have apertures with sleeves through which a nut and bolt assembly is received to secure the compressor and plate to the appliance. Another structure involves welding, to the bottom of the compressor housing, a plurality of support legs which are shaped and positioned to be placed upon posts which are interposed between the legs and the horizontal support surface, the posts having a pad or other resilient material to absorb noise and vibration.

The previously mentioned structures require the mounting apparatus to be welded onto the compressor housing. Welding increases the manufacturing cost and subjects the housing to heat which may result in undesired deformation of the housing. Additionally, the extra components (the plate and legs) increase the complexity, hence the chance of error during assembly.

Another type of structure involves supporting the compressor on a resilient material which separates the compressor from the horizontal support surface. One such structure comprises a plurality of hollow spring cylinders which engage locations on the bottom of the compressor housing, with the compressor resting on the springs. However, this structure requires that the compressor be supported at its top end to insure vertical stability, typically by welding a mounting stud to the compressor housing and providing additional support structure on the appliance cabinet.

Further prior art structure includes a circular resilient grommet of chloroprene rubber formed with an upstanding annular flange to engage the bottom of a compressor. The compressor is secured against movement by an elaborate mounting arrangement, thus requiring a plurality of components and assembling them which increases the complexity and cost.

Another prior art mounting structure is disclosed in U.S. Pat. No. 4,461,446 (Hannibal). A plurality of indentations are located on the underside of the compressor housing for receiving grommets. The grommets may be of resilient material so that barbs or other projections on the base surface become embedded in the grommets when the compressor is lowered onto the surface. Although an improvement over previous devices, the Hannibal mounting device still requires additional manufacturing steps to make the projections, to place the grommets on the projections, and to position the compressor so the grommets are within the indentations. Also, this device requires a modification of the compressor housing design to accommodate the indentations.

While these prior art structures serve to attach a compressor to an appliance cabinet, problems exist. The compressor imparts undesired vibration to the supporting base as well as causing noise to radiate from the compressor housing. The noise and vibration are readily transmitted from the compressor mechanism by an end plate which typically forms one end of the compressor housing. These problems are particularly pronounced with compressors having an end plate adjacent to the cylinder block of a rotary vane compressor mechanism because noise tends to radiate from the end plate.

Thus, what is needed is a mounting structure for attaching a compressor to a horizontal support surface in a vertical position with minimal additional structure on the compressor housing and appliance cabinet, so that vibration and noise radiating from the compressor housing are suppressed.

SUMMARY OF THE INVENTION

The present invention provides a mounting apparatus for mounting a hermetic compressor to a horizontal support surface in an upright position. A resilient boot engages the bottom end of the compressor to substantially cover its bottom end, thus isolating the compressor's vibration and suppressing noise radiating from the bottom end of the housing.

The cup-shaped boot has an annular sidewall which engages an annular groove on the compressor's bottom end. The sidewall has a sufficient thickness to support the compressor and keep its bottom end raised above the lower inner surface of the boot, creating a gap which serves to isolate the noise and vibrations of the compressor's motor unit. By matching the contour of the sidewall to the groove, the compressor is maintained in vertical alignment with the horizontal support surface.

The boot is made of a thermoplastic material which has beneficial properties regarding suppressing the transmission of noise and vibration to the horizontal support surface. The boot is attached to the compressor and the horizontal support surface by an adhesive, eliminating the need for additional parts or processing steps.

The present invention is, in one aspect, a vertically upright hermetic compressor for mounting to a horizontal support surface. It comprises a housing including a bottom end with an annular groove, a motor compressor unit operably disposed within the housing, and a mounting boot. The mounting boot is affixed to the housing bottom end and comprises a resilient body member engaged with the groove to vertically secure the housing.

Another aspect of the present invention is a mounting device for mounting a hermetic compressor to a horizontal support surface in a vertically upright manner. It comprises a resilient body member with a bottom surface on the horizontal support surface, and bonding material bonding the body to the horizontal support surface. The top surface has a receptacle for receiving a bottom portion of the compressor. The receptacle comprises an opening on the top surface shaped to receive a portion of the compressor and an upwardly extending annular edge shaped to fit into and be bonded to an annular groove on the bottom of the compressor.

An advantage of the present invention is that a compressor may be mounted to a support base without the need for hardware welded to the outside of the compressor housing. Another advantage of the present invention is that sound radiating from the bottom the compressor housing is suppressed. A further advantage of the mounting boot of the present invention is that the suppression of vibration and sound from a compressor mounted within an appliance cabinet is simply and economically achieved. Still another advantage of the mounting boot of the present invention is that the frictional engagement of the boot with the compressor housing is maintained despite vibratory and shock forces that might otherwise cause disengagement. An additional advantage of the present invention is that the mounting of a compressor to a support base is accomplished by attaching the compressor to a single part, i.e. a resilient body member, thereby simplifying installation. Also, an advantage is found in the present invention's versatility in mounting because of the integrally formed mounting surface.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
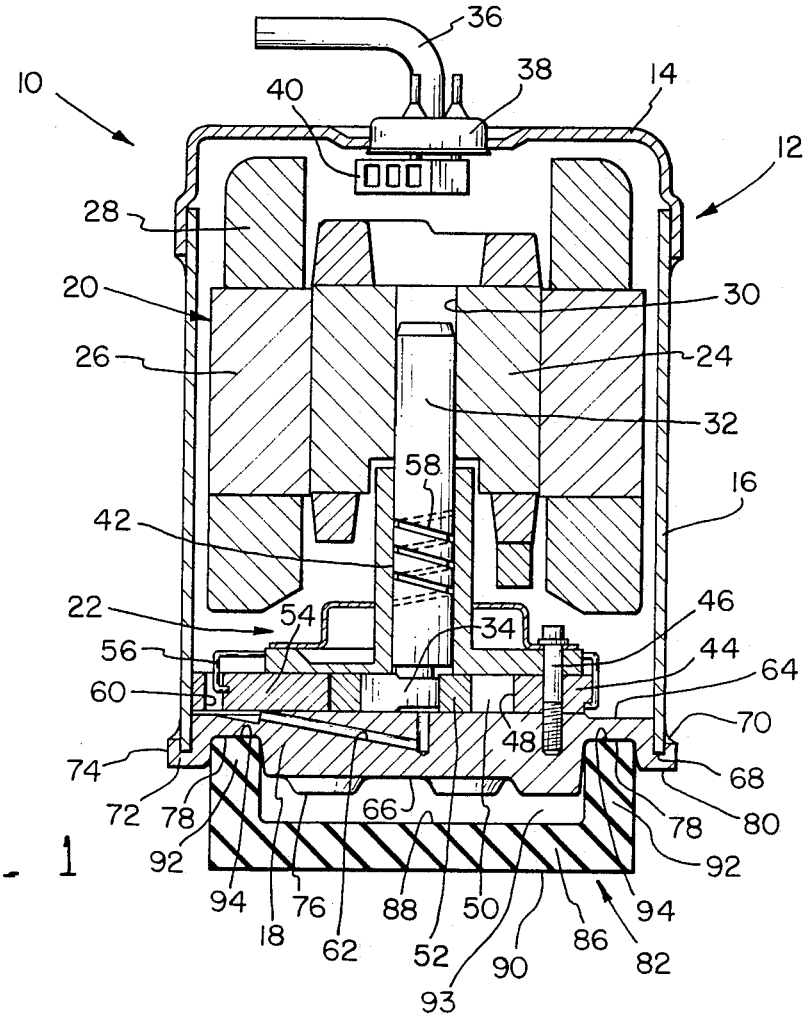
FIG. 1 is a sectional view of the hermetic compressor and mounting apparatus of the present invention.
Figure 2:
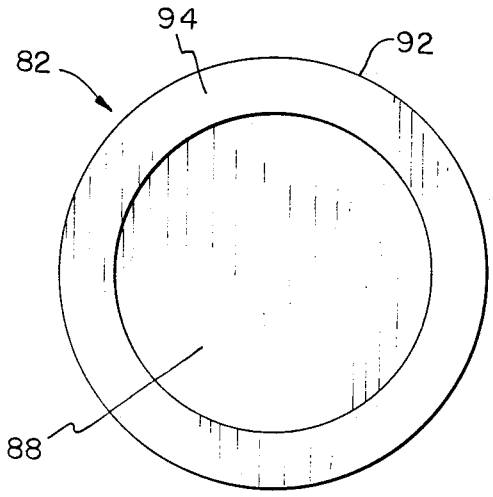
FIG. 2 is a top plan view of the mounting apparatus.

Corresponding reference characters indicate corresponding parts throughout the several views. The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

In the embodiment of the present invention as shown in the drawings, and in particular in FIG. 1, a vertical axis rotary hermetic compressor 10 is shown having a housing 12 which comprises a top portion 14, a generally cylindrical central portion 16, and a bottom end plate 18. The three housing components are hermetically secured together by welding or brazing. Disposed within housing 12 is a motor compressor unit comprising an electric motor 20 and a rotary vane compressor mechanism 22. Motor 20 comprises a rotor 24 and a stator 26 which has windings 28. Stator 26 is secured to housing 12 by an interference fit, e.g. shrink fitting.

Rotor 24 has a central aperture 30 and within which a rotatable crankshaft 32 is secured by an interference fit. Crankshaft 32 includes an eccentric portion 34 drivingly connected to compressor mechanism 22, which compresses refrigerant for discharge into the interior of housing 12. A refrigerant discharge tube 36 is sealingly connected to top portion 14 of the housing, e.g. by soldering. Similarly, a hermetic electric terminal 38 is also secured to top portion 14, so a connector 40 can connect terminal 38 to the interior of housing 12 for supplying electric power to motor 20.

Compressor mechanism 22 of FIG. 1 is a rotary vane-compressor mechanism similar to the device described in U.S. Pat. No. 4,730,994, which is hereby incorporated by reference. Only a brief description is provided here to aid in the understanding of the present invention. Compressor mechanism 22 includes a main bearing 42 in which crankshaft 32 is rotatably journalled, end plate 18, and a compressor cylinder block 44 disposed between main bearing 42 and end plate 18. As shown in FIG. 1, end plate 18 is secured to main bearing 42 by means of a plurality of bolts 46.

Cylinder block 44 defines an axial bore 48; main bearing 42, end plate 18, and bore 48 define a compression chamber 50. A roller 52 surrounds crankshaft eccentric 34 in compression chamber 50, and cooperates with a sliding vane 54 for compressing a refrigerant fluid in compression chamber 50 in a known manner. Additionally, a vane spring 56 provides a biasing force to the back of sliding vane 54. Compressor mechanism also includes a lubrication system similar to that described in U.S. Pat. No. 4,730,994, incorporated herein by reference, including helical passageways 58 formed in crankshaft 32, axial passageway 60 formed in cylinder block 44, and radial passageway 62 formed in end plate 18.

End plate 18 is a part of compressor mechanism 22 and serves as the bottom portion of housing 12. It is a circularly shaped plate having a top surface 64 and a bottom surface 66. At its periphery, an annular recess 68 is formed in top surface 64 which receives central portion 16, with weldment 70 securing portion 16 to plate 18. End plate 18 also includes a flange portion 72 having a greater diameter than central portion 16 to extend radially outward to the outer circumference of flange 72 which defines facing surface 74. The bottom surface 66 of end plate 18 comprises a middle circular surface 76 surrounded by an annular groove 78, which is circumferentially bordered by an outer annular support surface 80. Groove 78 serves as a support portion, for mounting compressor housing 12 to boot 82. The plane defined by outer annular support surface 80 lies between the planes defined by surface 76 and groove 78.

Figure 3:
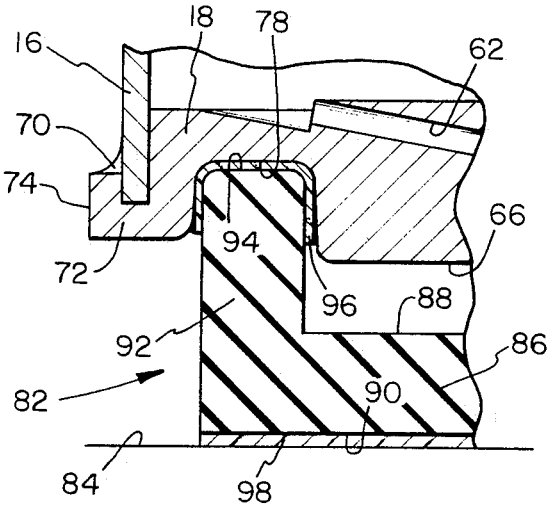
FIG. 3 is an enlarged fragmentary view of FIG. 1.

The present invention comprises mounting the compressor 10 upon a mounting boot 82, as shown in FIG. 1, to mount compressor 10 in an upright position on a horizontal support surface 84 (see FIG. 3). The particular shape of the preferred embodiment is for use with a particular rotary compressor configuration, although the mounting boot of the present invention can be adapted for use with other shapes using the teachings of this disclosure. Mounting boot 82 is a unitary piece molded from Santoprene thermoplastic rubber material available from Monsanto Corporation of St. Louis, Missouri. However, any other suitable resilient, flexible material may be used.

Boot 82 is generally cup-shaped, having a circular, planar base portion 86 with top surface 88 and bottom surface 90. A circumferential wall portion 92 upwardly extends from the periphery of base 86, ending with an upper rim 94. Geometrically, boot 82 defines a cylindrically shaped solid having an open end defined by rim 94 and a closed end defined by base 86. The thickness of wall 92 approximately matches the width of groove 78, and the thickness of base 86 has a similar dimension.

The connection of boot 82 to compressor 10 is depicted in FIG. 3. An adhesive layer 96 is placed over rim 94 to connect boot 82 with groove 78 of end plate 18. Additionally, an adhesive layer 98 is disposed under bottom surface 90 between boot 82 and horizontal support surface 84. Although a variety of adhesives can be used, a suitable adhesive is an RTV rubber adhesive, manufactured by General Electric.

The assembly of the compressor and mounting apparatus is relatively simple and economical. Adhesive layer 98 is applied to rim 94, preferably with the adhesive layer extending downwardly on the outer and inner surfaces of wall 92. End plate 18 of housing 12 is then placed over boot 82 so that rim 94 fits into groove 78. Once bonded together, compressor 10 can be mounted on horizontal support surface 84 by adhesive layer 98 or other means.

Wall 92 has a thickness which is able to withstand lateral deflection under the weight of compressor 10. Bottom surface 66 of end plate 18 does not physically abut surface 88 of boot 82, with the gap between those surfaces providing a vibration and noise isolation chamber 93 for compressor 10. Additionally, the material of boot 82 itself has characteristics which inhibit the transmission of noise and vibration.

While this invention has been described as having a preferred design it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A vertically upright hermetic compressor assembly for mounting to a horizontal support surface, comprising:

a housing including a bottom end, said bottom end having an annular downwardly facing groove;

a motor compressor unit operably disposed within said housing;

a resilient mounting boot, abutting said housing bottom end, for mounting said compressor to a horizontal support surface, said mounting boot comprising a resilient body member having an annular sidewall with a rim engaged within said groove to support vertically said housing, and said body further having a base with a planar lower surface adapted to abut the horizontal support surface, and an upper surface facing said housing bottom end and spaced therefrom to define an enclosed space between said housing bottom end and said base upper surface thereby isolating noise produced by said motor compressor; and bonding means contacting said groove and said sidewall rim for securing together said housing and said mounting boot.

2. The compressor assembly of claim 1 wherein said sidewall has a thickness approximately equal to the radial thickness of said groove.

3. The compressor assembly of claim 2 wherein said base has a thickness approximately equal to said sidewall thickness.

4. The compressor assembly of claim 1 wherein said bonding means is an adhesive.

5. The compressor assembly of claim 4 wherein said adhesive comprises an RTV rubber adhesive.

6. A vertically upright hermetic compressor assembly mounted to a horizontal support surface, comprising:

an outer housing having operably disposed therein a motor compressor unit, said housing including a top end, a generally cylindrical central portion, and a bottom end having an annular groove;

mounting means for mounting said compressor to the horizontal support surface in a vertically upright manner, said mounting means comprising a body member attachable to the horizontal support surface, said body member including a resilient upwardly extending wall portion with an upper rim that is disposed in said annular groove to support vertically said compressor, and said body member also including a base having a planar lower surface abutting the horizontal support surface, and an upper surface facing said housing bottom end and spaced therefrom to define an enclosed space between said housing bottom end and said base upper surface thereby isolating noise produced by said motor compressor.

7. The compressor assembly of claim 6 wherein said base has a thickness approximately equal to the thickness of said wall portion.

8. The compressor assembly of claim 6 wherein sad mounting means is attached to the horizontal support surface by an adhesive.

9. The compressor assembly of claim 6 wherein said upper rim is attached to said groove by an adhesive.

* * * * *